US008418765B2

(12) United States Patent
Ferrara et al.

(10) Patent No.: US 8,418,765 B2
(45) Date of Patent: Apr. 16, 2013

(54) COMBINED PILOTING METHOD OF REMOTE OPERATED UNDERWATER VEHICLES, DEVICE FOR ITS IMPLEMENTATION AND SYSTEM USING THE SAME

(75) Inventors: Paolo Ferrara, Milan (IT); Michele Filippini, Preganziol (IT); Roberto Finotello, Mestre (IT); Tiberio Grasso, Spinea (IT)

(73) Assignee: ENI S.p.A., Rome (IT)

( * ) Notice: Subject to any disclaimer, the term of this patent is extended or adjusted under 35 U.S.C. 154(b) by 133 days.

(21) Appl. No.: 12/936,592

(22) PCT Filed: Apr. 6, 2009

(86) PCT No.: PCT/IB2009/005205
§ 371 (c)(1),
(2), (4) Date: Dec. 20, 2010

(87) PCT Pub. No.: WO2009/125279
PCT Pub. Date: Oct. 15, 2009

(65) Prior Publication Data

US 2011/0093138 A1 Apr. 21, 2011

(30) Foreign Application Priority Data

Apr. 7, 2008 (IT) ..... MI2008A0603

(51) Int. Cl.
*E21B 7/12* (2006.01)

(52) U.S. Cl.
USPC ..... 166/339; 166/343; 166/341; 166/353; 405/195.1

(58) Field of Classification Search ..... 166/339, 166/341, 343, 353; 405/195.1
See application file for complete search history.

(56) References Cited

U.S. PATENT DOCUMENTS 3,065,799 A * 11/1962 McCarty, Jr ..... 416/23
3,504,740 A * 4/1970 Manning ..... 166/339

(Continued)

FOREIGN PATENT DOCUMENTS

| | | |
|---|---|---|
| WO | 01 21476 | 3/2001 |
| WO | 01 21478 | 3/2001 |
| WO | 01 21479 | 3/2001 |

OTHER PUBLICATIONS

International Search Report issued Apr. 21, 2010 in PCT/IB09/005205 filed Apr. 6, 2009.

(Continued)

*Primary Examiner* — Thomas Beach
*Assistant Examiner* — Aaron Lembo
(74) *Attorney, Agent, or Firm* — Oblon, Spivak, McClelland, Maier & Neustadt, L.L.P.

(57) ABSTRACT

A combined piloting method of remote operated underwater vehicles includes: connecting, to a vertical profile, a constraint device including at least two arms arranged at a reciprocal fixed angular position, each of the at least two docking arms including at a first end a device for the hooking of a remote operated underwater vehicle, the at least two docking arms being constrained at one of their second ends to a device for the sliding and rotating hooking to the vertical profile; connecting at least two remote operated vehicles to the constraint device; detecting the position of the overall structure consisting of the constraint device and remote operated vehicles; detecting the orientation of each of the remote operated vehicles; receiving data relating to the position and orientation to be reached; determining the power required by each remote operated vehicle; and transmitting related commands to each vehicle.

14 Claims, 4 Drawing Sheets

U.S. PATENT DOCUMENTS

| | | | | |
|---|---|---|---|---|
| 3,528,497 | A * | 9/1970 | Lehman | 166/360 |
| 3,625,171 | A * | 12/1971 | Bailey | 114/314 |
| 3,702,597 | A * | 11/1972 | Odum et al. | 405/188 |
| 4,136,633 | A * | 1/1979 | Homer et al. | 114/264 |
| 4,776,727 | A * | 10/1988 | Saffrhan | 405/225 |
| 5,516,235 | A * | 5/1996 | Stangroom | 405/188 |
| 5,540,523 | A * | 7/1996 | Foret et al. | 405/232 |
| 5,570,324 | A * | 10/1996 | Geil | 367/124 |
| 5,894,450 | A * | 4/1999 | Schmidt et al. | 367/134 |
| 5,921,713 | A * | 7/1999 | Gjessing et al. | 405/170 |
| 6,106,198 | A * | 8/2000 | Børseth | 405/223.1 |
| 6,167,831 | B1 | 1/2001 | Watt et al. | |
| 6,223,675 | B1 | 5/2001 | Watt et al. | |
| 6,257,162 | B1 | 7/2001 | Watt et al. | |
| 6,390,012 | B1 | 5/2002 | Watt et al. | |
| 6,561,276 | B2 * | 5/2003 | Hamilton | 166/339 |
| 6,644,409 | B1 * | 11/2003 | Strømberg et al. | 166/349 |
| 6,820,008 | B1 * | 11/2004 | van Smirren et al. | 702/2 |
| 7,140,445 | B2 * | 11/2006 | Shahin et al. | 166/380 |
| 7,503,391 | B2 * | 3/2009 | McCanna et al. | 166/343 |
| 2003/0049076 | A1 * | 3/2003 | Bekkevold et al. | 405/170 |
| 2004/0007362 | A1 * | 1/2004 | Rodgers et al. | 166/344 |
| 2008/0008037 | A1 * | 1/2008 | Welker | 367/21 |
| 2008/0284441 | A1 * | 11/2008 | Kowalczyk et al. | 324/334 |
| 2010/0089126 | A1 * | 4/2010 | Sweeney | 73/40 |
| 2010/0144181 | A1 * | 6/2010 | Karlsen et al. | 439/193 |
| 2012/0125623 | A1 * | 5/2012 | Cargol et al. | 166/344 |
| 2012/0132435 | A1 * | 5/2012 | Yemington | 166/355 |

OTHER PUBLICATIONS

US 6,189,476, 02/2001, Watt et al. (withdrawn)

* cited by examiner

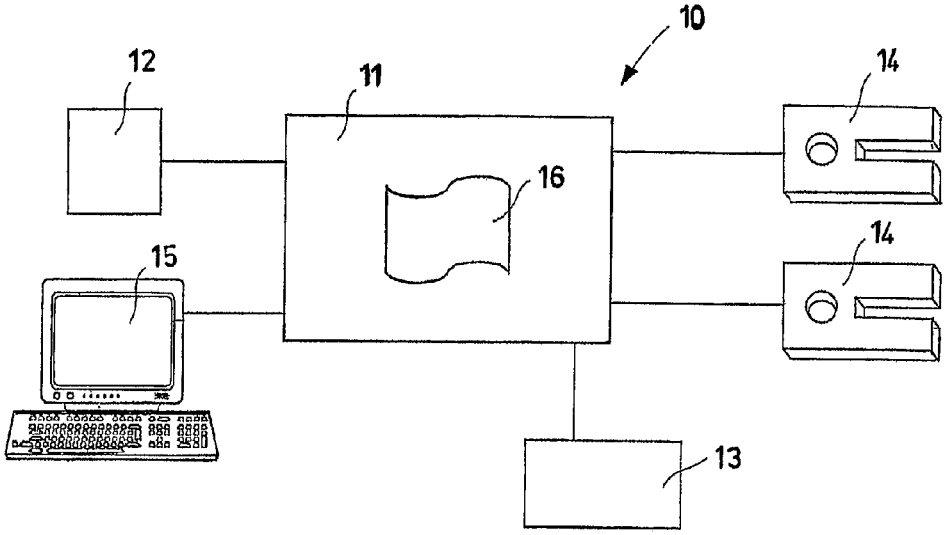
Fig.1
Fig.2
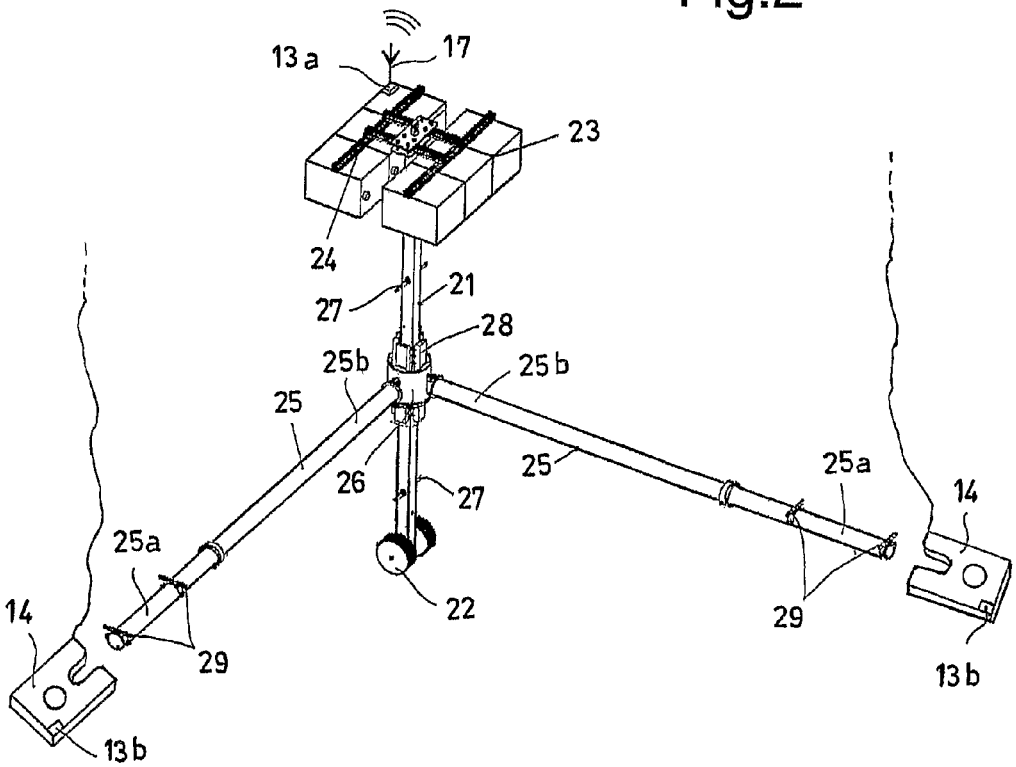

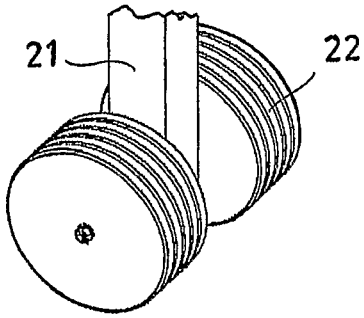
Fig.2a
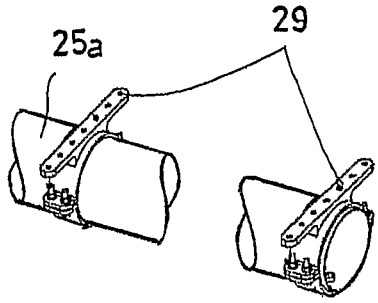
Fig.2b
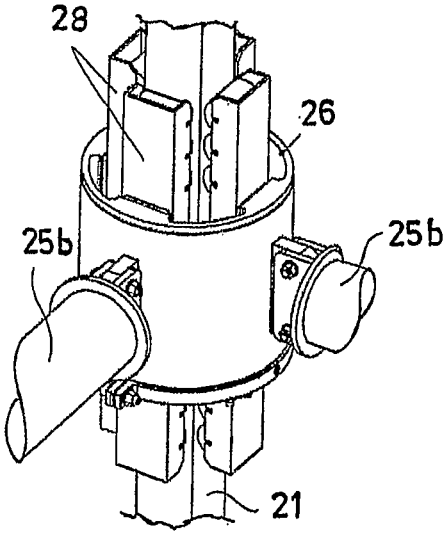
Fig.2c
Fig.2d
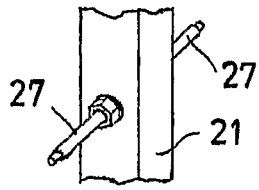

COMBINED PILOTING METHOD OF REMOTE OPERATED UNDERWATER VEHICLES, DEVICE FOR ITS IMPLEMENTATION AND SYSTEM USING THE SAME

BACKGROUND OF THE INVENTION

1. Field of the Invention

The present invention relates to a combined piloting method of remote operated underwater vehicles, a device for the implementation of said method and a system using the same.

2. Description of the Related Art

The use of remote operated underwater vehicles, also called ROV (remote operated vehicle) in effecting construction and maintenance operations of underwater structures, is widely used in the offshore and scientific environment and for the installation of building structures.

The necessity of operating with increasingly more voluminous structures and/or requiring particular operations, has led to the production of more powerful and high-performance ROVs, also having special equipment for the particular intervention.

Operative procedures have also been elaborated, specifically for particular operations, such as for example the lowering and positioning of objects in an underwater environment, visual inspection during underwater installation operations and the reduction of disturbances during the moving of long or large-sized structures.

There are currently various types of different ROVs, each of which can be used for effecting a certain operation.

In particular, low-power ROVs which are generally used only for the visual inspection of underwater operations, can be distinguished from different types of high-power ROVs which differ in their use, for example the moving of objects and/or actuating operations through robotic systems.

In order to be able to effect the numerous necessary operations, for example in offshore oil production, an equivalent number of different ROVs each belonging to a particular type of use is therefore necessary.

The boats used for offshore operations, however, are generally not equipped with a high number of different types of remote operated vehicles, in particular due to their encumbrances and significant costs.

These crafts are generally equipped with low-power ROVs, also called inspection ROVs, which, however, cannot be used for carrying out operations to be effected by high-power ROVs.

This is currently not possible even when the lower power offered by inspection ROVs is satisfied through the use of a plurality of said vehicles.

The use of various inspection ROVs in fact does not achieve the results offered by a high-power ROV as, for this purpose, it is necessary to have a coordination of the operations of the single inspection ROVs which cannot be achieved through the currently known remote piloting methods which only allow to pilot the single ROVs separately.

In the absence of this fine coordination, the single inspection ROVs used for example in moving objects in an underwater environment could develop contrasting forces on said object making it ungovernable and even damaging it.

BRIEF SUMMARY OF THE INVENTION

An objective of the present invention is to overcome the above drawbacks and in particular to create a combined piloting method of remote operated underwater vehicles which allows operations requiring a high power to be effected through the combination of remote operated vehicles with a lower power.

Another objective of the present invention is to provide a device for the piloting of remote operated underwater vehicles which allows the action of a plurality of remote operated vehicles to be combined.

A further objective is to provide a piloting system of remote operated underwater vehicles which implements said method.

These and other objectives according to the present invention are achieved by providing a combined piloting method of remote operated underwater vehicles, a device for the implementation of said method and a system using the same as specified in the independent claims.

Further aspects of the invention are object of the dependent claims.

BRIEF DESCRIPTION OF THE DRAWINGS

The characteristics and advantages of a combined piloting method of remote operated underwater vehicles according to the present invention will appear more evident from the following illustrative and non-limiting description, referring to the enclosed schematic drawings, in which:

FIG. 1 is a schematic representation of a system for the combined piloting of remote operated underwater vehicles according to the present invention;

FIG. 2 shows a device for the constraint of a plurality of remote operated vehicles for the implementation of the combined piloting method according to the invention;

FIGS. 2*a*-2*d* illustrate enlarged details of FIG. 2;

DETAILED DESCRIPTION OF THE INVENTION

Figure 3:
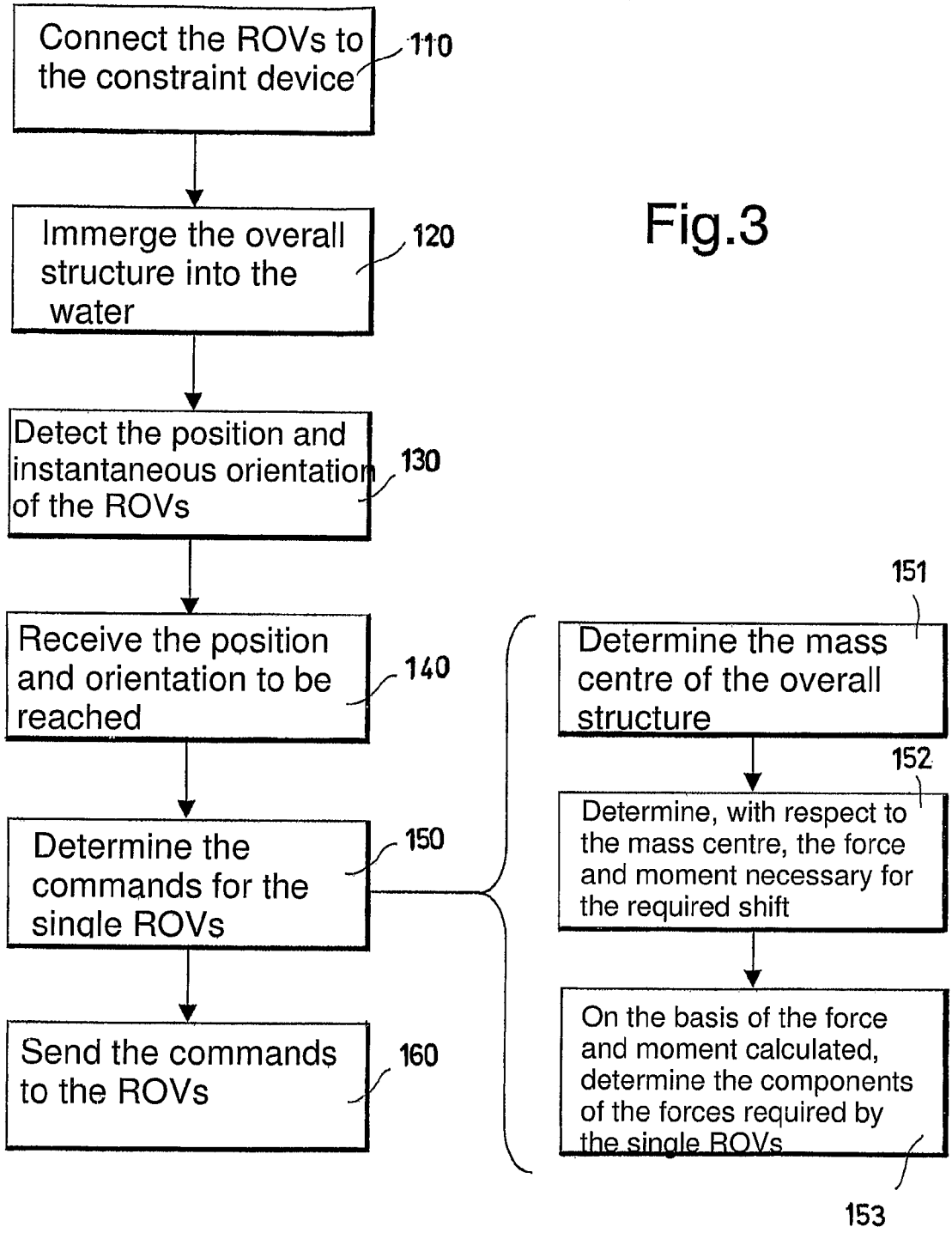
FIG. 3 is a block scheme of combined piloting method according to the present invention.

With reference to the figures, these first show a system for the combined piloting of remote operated underwater vehicles according to the present invention, indicated as a whole with 10. Said system 10 comprises a processing unit 11 connected at the output to digital communication inputs of the control systems of at least two remote operated vehicles or ROVs 14 for transmitting commands to the same.

For this purpose, the processing unit 11 comprises software means 16 which determine the commands to be transmitted to the ROVs 14 through the implementation of a combined piloting method of said vehicles 14 described further on.

According to the present invention, the ROVs 14 are rigidly connected to a device 20 for their constraint to allow their combined piloting.

The processing unit 11 input is also connected to an interface 12 for the entry of operator commands, such as for example a console with a joystick, and to a system 13 for determining the position of said constraint device 20, and also the orientation of at least two ROVs 14.

For this purpose, a global positioning system 13*a* is used for example, preferably of the high precision type, such as the DGPS system (Differential Global Positioning System), which allows a metric or submetric accuracy to be reached, situated on the constraint device 20 and associated with the compass 13*b* installed in the ROVs 14. Otherwise, for determining the position of the constraint device 20, it is possible to envisage an acoustic positioning system situated at the sea bottom (not shown), preferably of the transceiver type.

Finally, the processing unit 11 preferably comprises a display interface 15 for the bidimensional and/or three-dimensional representation of the instantaneous position of the vehicles 14.

The constraint device 20 comprises at least two docking arms 25 arranged at a reciprocal fixed angular position, each equipped, at a first end 25*a*, with means for rigidly connecting a ROV 14. Said at least two docking arms 25 are also constrained, in correspondence with their second end 25*b*, to means 26 for the sliding and rotating hooking to a vertical profile 21.

In a preferred but non-limiting embodiment, the hooking means 26 are a sleeve 26 internally equipped with trolleys 28 which allow the whole unit, consisting of the sleeve 26 and arms 25, to slide along the vertical profile 21 limitedly to a trajectory defined by two mechanical run end elements 27.

The functioning of the piloting system of remote operated underwater vehicles according to the present invention is the following.

The constraint device 20 is connected to a vertical profile 21.

The ROVs 14 are subsequently rigidly connected to the constraint device 20 (phase 110) and the overall structure 14, 20 deployed in water (phase 120), monitoring its position and orientation through the system 13.

Alternatively, the connection of the ROVs (phase 110) can take place when the device 20 is already in water. The processing unit 11, by running the software means 16, determines (phase 150) the commands to be given to the same 14 on the basis of the position and instantaneous orientation of said vehicles 14 (phase 130) and information on the position and orientation to be reached inserted by an operator through the interface 12 (phase 140).

Said commands are then transferred to the controllers of the ROVs 14 (phase 160) so that these can command the desired forces to the propellers of the ROVs 14.

For the determination of the commands to be given to the ROVs 14, the Thruster Allocation Matrix (TAM) algorithm is applied on the base of the overall structure consisting of at least two ROVs rigidly connected to the device 20 for the combined piloting.

For purely illustrative and non-limiting purposes, the determination of the commands to be given to the ROVs is described hereunder with reference to an overall structure consisting of only two ROVs 14 connected to a device 20 for the combined piloting as specified above.

Figure 4:
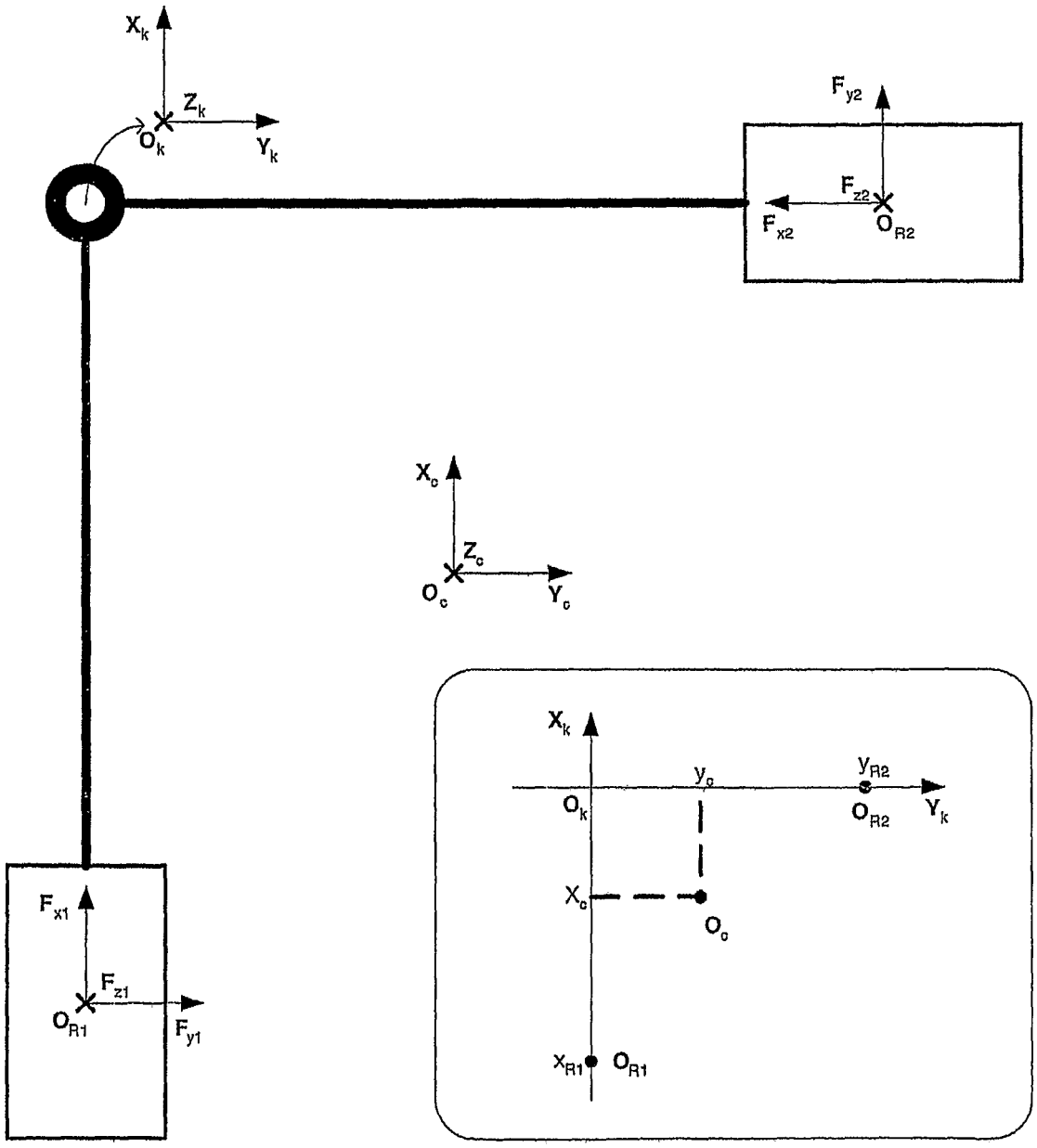
FIG. 4 is a graph representing the reference system of the constraint device according to the present invention.

The mass centre $O_c$ of the overall structure 14, 20 is first determined (phase 151) in order to construct a reference system such as that illustrated in FIG. 4, in which the coordinates $[x_c, y_c, 0]$, $[x_{R1}, 0, 0]$, $[0, y_{R2}, 0]$, are respectively defined of the mass centre $O_c$, the reference system $O_{R1}$ of a first ROV 14 and the reference system $O_{R2}$ of a second ROV 14, expressed with respect to the navigation reference system $(O_K, X_k, Y_k, Z_k)$.

Upon defining $(F_{x1}, F_{y1}, F_{z1})$ the force applied by the first ROV 14 to the system, and $(F_{x2}, F_{y2}, F_{z2})$ the force applied by the second ROV to the system, according to the Thruster Allocation Matrix algorithm, these forces generate a resulting force $(F_X, F_y, F_z)$ and a resulting moment $(M_x, M_y, M_z)$ with respect to the reference system of the mass centre $O_c$ of the overall structure 14, 20, whose components are calculated by means of the following matricial calculation:

$$\begin{bmatrix} F_x \\ F_y \\ F_z \\ \hline M_x \\ M_y \\ M_z \end{bmatrix} = \left[\begin{array}{ccc|ccc} 1 & 0 & 0 & 0 & 1 & 0 \\ 0 & 1 & 0 & -1 & 0 & 0 \\ 0 & 0 & 1 & 0 & 0 & 1 \\ \hline 0 & 0 & -y_c & 0 & 0 & (y_{R2} - y_c) \\ 0 & 0 & (x_c - x_{R1}) & 0 & 0 & x_c \\ y_c & (x_{R1} - x_c) & 0 & x_c & (y_c - y_{R2}) & 0 \end{array}\right] \cdot \begin{bmatrix} F_{x1} \\ F_{y1} \\ F_{z1} \\ \hline F_{x2} \\ F_{y2} \\ F_{z2} \end{bmatrix}$$

On the basis of the information inserted by the user with respect to the orientation and position that the overall structure 14, 20 must reach, the force $(F_x, F_y, F_z)$ and the moment $(M_x, M_y, M_z)$ necessary for effecting the required shift (phase 152), are determined in real time.

On the basis of these data, the components are determined of the forces $F_{x1}, F_{y1}, F_{z1}, F_{x2}, F_{y2}, F_{z2}$ applied by the single ROVs 14 through the matricial calculation specified above (phase 153).

Thanks to the processing unit 11 comprising the software means 16, the user can remote pilot the plurality of ROVs 14 rigidly constrained to a constraint device 20 as if he were piloting a single vehicle.

It is therefore not necessary to manually coordinate the commands given to the single ROVs 14.

The processing unit 11, by running the software means 16 which implement the combined piloting method according to the present invention, automatically translates the commands given by the operator to the overall structure 14, 20 into specific commands for the single vehicles 14.

The Applicant effected various tests for validating the invention positively verifying the capability of following desired trajectories of any type and maintaining a desired position and orientation.

In particular, a special vertical profile 21 was conceived for these tests, equipped with a ballast 22 in the low part and a floating element 23 connected to the top structure 24.

Once the constraint device 20 has been connected to said vertical profile 21, it is maintained with the main axis in vertical when released into the water.

A system for determining the position 13*a* of the DGPS type whose aerial 17 was installed on the top structure 24 of the vertical profile 21, was used for the validation tests.

In effecting these tests, traction disturbances of the structure were also applied.

The system 10 however proved capable of maintaining the position and orientation error of the overall structure 14, 20 below margins of centimetres in position and a few degrees with respect to orientation.

The characteristics of the device, object of the present invention, as also the related advantages, are evident from the above description.

The possibility of the combined piloting of a plurality of ROVs through the constraint device according to the present invention and the related piloting method, also allows different types of ROVs to be used for effecting different operations.

It is in fact sufficient to rigidly constrain a suitable number of ROVs through the device of the present invention to obtain an overall structure capable of supplying the power necessary for the particular operation, which can be piloted with the same simplicity as guiding a single vehicle.

It is therefore possible to use, for example, a plurality of inspection ROVs, generally available on crafts used for offshore operations, for effecting operations which require the use of vehicles capable of supplying a greater power.

The Applicant has also verified that the combined piloting system according to the present invention, if applied in oil production, in particular for the construction of underwater well heads, allows the position and orientation of large modules of well heads to be controlled making the use of guidelines so far necessary, superfluous.

Finally, the device thus conceived can evidently undergo numerous modifications and variants, all included in the invention; furthermore, all the details can be substituted by technically equivalent elements. In practice, the materials used, as also the dimensions, can vary according to technical requirements.

The invention claimed is:

1. A constraint device of at least two remote operated underwater vehicles comprising:

at least two docking arms arranged at a reciprocal fixed angular position, each of said at least two docking arms comprising at a first end, means for the hooking of a remote operated underwater vehicle, said at least two docking arms being constrained at a second end, to means for the sliding and rotating hooking to a vertical profile, and a controller configured to detect a position of an overall structure including the constraint device and the remote operated underwater vehicles, and an orientation of each of the remote operated underwater vehicles, receive a desired position of the overall structure to be reached and a desired orientation to be reached for each of the remote operated underwater vehicles, determine power required by each of the remote operated underwater vehicles to reach the desired position of the overall structure and the desired orientation for each of the remote operated underwater vehicles, and transmit commands based on the required power to each of the remote operated underwater vehicles, wherein the required power is determined by determining a mass center of the overall structure, determining a force with respect to the mass center and a resulting moment with respect to the mass center necessary for reaching the desired position of the overall structure to be reached and the desired orientation to be reached for each of the remote operated underwater vehicles, and determining components of forces applied to each of the remote operated underwater vehicles based on the necessary force with respect to the mass center and resulting moment with respect to the mass center.

2. The constraint device according to claim 1, wherein said hooking means are a sleeve internally equipped with trolleys.

3. The constraint device according to claim 1 or 2, wherein said hooking means can be constrained to said vertical profile so as to slide limitedly between two end switches.

4. A combined piloting method of remote operated underwater vehicles comprising:

connecting a constraint device according to claim 1 to a vertical profile;

rigidly connecting at least two remote operated underwater vehicles to the constraint device;

detecting a position of an overall structure including said constraint device and said remote operated underwater vehicles;

detecting an orientation of each of said remote operated underwater vehicles;

receiving data relating to a desired position to be reached and a desired orientation to be reached;

determining the power required by each remote operated vehicle and transmitting related commands to each vehicle.

5. The combined piloting method of remote operated underwater vehicles according to claim 4, wherein said phase for determining the power required by each vehicle comprises:

determining the mass center of said overall structure;

on the basis of said data received, determining a force and a resulting moment, with respect to said mass center, necessary for reaching said position and orientation;

calculating components of the forces required by each of the vehicles using a matricial transformation of said force and said resulting moment with respect to the mass center.

6. The combined piloting method of remote operated underwater vehicles according to claim 5, wherein matricial transformation takes place according to a Thruster Allocation Matrix algorithm.

7. A combined piloting system of remote operated underwater vehicles comprising:

a processing unit connected at the input to a system for determining the position and orientation of at least two remote operated underwater vehicles, and at an output to control systems of said at least two vehicles, said processing unit configured to execute with a processor a program for a combined piloting method of said at least two vehicles stored in a non-transitory computer readable medium, the program including:

detecting a position of an overall structure including said constraint device and said remote operated vehicles;

detecting an orientation of each of said remote operated vehicles;

receiving data relating to the position and orientation to be reached;

determining the power required by each remote operated vehicle and transmitting related commands to each vehicle, wherein said at least two remote operated underwater vehicles are rigidly connected to each other by a constraint device according to claim 1.

8. The combined piloting system of remote operated underwater vehicles according to claim 7, wherein said processing unit is connected to an interface for the entry of commands.

9. The combined piloting system of remote operated underwater vehicles according to claim 7 or 8, wherein said processing unit comprises a display interface for at least one of bidimensional or three-dimensional representation of data.

10. The combined piloting system of remote operated underwater vehicles according to claim 7, wherein said system for determining the position and orientation of at least two remote operated underwater vehicles comprises a global positioning system provided on said constraint device and a plurality of compasses each installed in a vehicle.

11. The combined piloting system of remote operated underwater vehicles according to claim 7, wherein said system for determining the position and orientation of at least two remote operated underwater vehicles comprises an acoustic positioning system situated at the sea bottom and a plurality of compasses each installed in a vehicle.

12. The constraint device according to claim 1, wherein a first end of the vertical profile include a ballast.

13. The constraint device according to claim 12, wherein a second end of the vertical profile includes a floating element.

14. The constraint device according to claim 1, wherein the components of forces applied to each of the remote operated underwater vehicles are in a first direction along a direction of the docking arm to which the remote operated underwater vehicle is hooked, in a second vertical direction, and in a third direction perpendicular to both the first and second directions.

* * * * *